United States Patent [19]

Pollard

[11] 4,023,614

[45] May 17, 1977

[54] GAS SHROUD

[75] Inventor: Bernard Robert Pollard, Aliquippa, Pa.

[73] Assignee: Jones & Laughlin Steel Corporation, Pittsburgh, Pa.

[22] Filed: Apr. 2, 1976

[21] Appl. No.: 673,231

[52] U.S. Cl. ..... 164/259; 164/66; 164/82; 164/281 R

[51] Int. Cl.² ..... B22D 11/10

[58] Field of Search ..... 164/66, 259, 337, 82, 164/281

[56] References Cited

UNITED STATES PATENTS

| | | | |
|---|---|---|---|
| 3,439,735 | 4/1969 | Holmes | 164/259 |
| 3,908,734 | 9/1975 | Pollard | 164/66 |
| 3,963,224 | 6/1976 | Pollard | 164/66 X |

FOREIGN PATENTS OR APPLICATIONS

| | | | |
|---|---|---|---|
| 371,880 | 4/1932 | United Kingdom | 164/66 |

OTHER PUBLICATIONS

Samway et al., "Gas Shrouding of Strand Cast Steel at Jones & Laughlin Steel Corporation", *Journal of Metals*, Oct., 1974, pp. 28–34.

*Primary Examiner*—Ronald J. Shore
*Attorney, Agent, or Firm*—G. K. White; T. A. Zalenski

[57] ABSTRACT

The oxygen content in a continuous casting mold atmosphere may be minimized by use of a gas shroud with tubular members having the following area relationship:

$$\frac{\text{cross-sectional area of inlet tube}}{2 \times \text{cross-sectional area of outlet tube}} \geq \text{about } 0.7.$$

2 Claims, 4 Drawing Figures

GAS SHROUD

This invention relates to the discovery that the degree of protection of molten metal in a continuous casting mold, as measured by oxygen content of the protective atmosphere established in the mold, may be enhanced through selection of an area relationship between the inlet and outlet tubular members of a gas shroud of the general type disclosed in my prior U.S. Pat. No. 3,908,734 and in my copending U.S. patent application Ser. No. 600,330 and now U.S. Pat. No. 3,963,224. It has been determined that a gas shroud having a ratio of cross-sectional inlet tube area to two times that of the outlet tube of about a minimum of 0.7 will lead to the effective minimization of oxygen content in the mold.

Accordingly, it is an object of the invention to provide a gas shrouding device capable of minimizing the amount of contaminants, such as oxygen, in the protective atmosphere established in continuous casting molds and thereby further minimize the potential for contamination or reoxidation of molten metal during its transfer at the teeming portion of the continuous casting process. Other objectives and advantages of the invention will become apparent to those skilled in the art from the following description of the invention.

Figure 1:
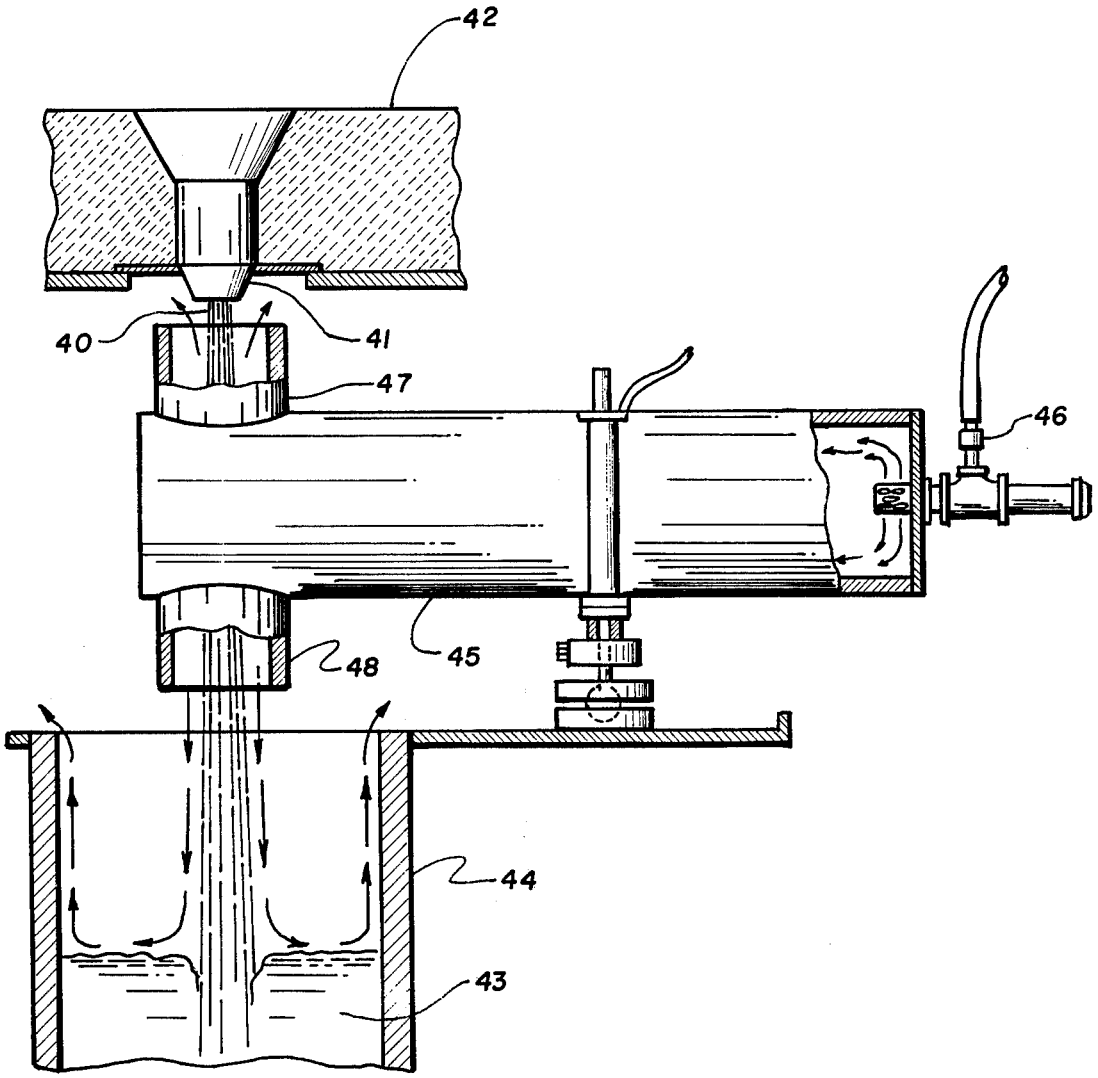
FIG. 1 is a gas shrouding device shown in combination with molten metal distribution means and a continuous casting mold.

The gas shrouding device of the invention is an improvement to that disclosed in my prior U.S. Pat. No. 3,908,734. The aforementioned device functions to protect liquids during transfer between containers through the establishment and maintenance of a protective gaseous atmosphere around a transferred liquid stream. A highly advantageous application of the gas shroud is in connection with the continuous casting of molten metal such as steel. While my prior U.S. Pat. No. 3,908,734 may be referred to for greater detail concerning various components of the gas shroud illustrated in FIG. 1, certain essential elements of such shroud should be discussed in the context of the present invention. Molten metal stream 40 is transferred from distribution orifice 41 of tundish 42, passes through the shroud positioned between the tundish and continuous casting mold 44, and is collected in pool 43 which is contained in the mold. Molten metal 40 is protected from oxidation during its passage between containers by a protective gaseous atmosphere, such as an inert or combustible gas. A protective gas (depicted by the arrows) is fed into inlet tube 45 from protective gas delivery means 46 and then passes through an interconnecting passageway into open-ended outlet tubes 47 and 48 and ultimately exits from the open ends of the tubes. As gas exits from the end of outlet tube 48 it passes into and fills continuous casting mold 44 thereby establishing and maintaining a protective gaseous atmosphere in the mold which serves to protect molten metal pool 43 from contamination. It is the aspect of the maintenance of mold atmosphere purity in which the primary advantages of this invention are manifested.

To develop a relationship of the influence of inlet and outlet tube cross-sectional areas upon atmosphere purity, as measured by percent oxygen in the mold, a series of simulated laboratory trials were conducted. It is considered that the trials constitute a reasonable simulation of conditions that would be encountered during actual continuous casting. The testing unit consisted of a full scale model of a commercially usable continuous casting machine with respect to tundish nozzle assembly unit, gas shrouding apparatus and casting mold. The test apparatus may be operated under static or dynamic (mold oscillation) conditions. In the latter situation, the mold assembly was operated with a 1 inch stroke and 36 cycles per minute oscillation. All trials were conducted with the shroud attached to the mold table.

All testing was accomplished with use of a 6 inches × 6 inches water filled mold and a nitrogen flow of 20 s.c.f.m. A steel rod was used to simulate the teeming stream. A distance of ¾ inch was maintained from the bottom of the outlet tube and the top of the mold while a 1 ¼ inches distance was maintained between the top of the outlet tube and nozzle during stationary trials. In addition, an outlet tube having an inside diameter of 5 inches was employed for all tests. The above procedure enabled a series of inlet tube sizes to be evaluated. The results of such trials are shown in the Table.

TABLE

| Inlet Tube Diameter, In. | Oxygen Content, % | | | |
|---|---|---|---|---|
| | Nozzle | | Mold | |
| | Stationary | Oscillating | Stationary | Oscillating |
| 2½ | 0.13 | 0.043 | 1.10 | 1.10 |
| 4½ | 0.020 | 0.006 | 0.90 | 0.67 |
| 5 | 0.15 | 0.030 | 0.32 | 0.17 |
| 6 | 0.026 | — | 0.050 | — |
| 8[a] | 0.065 | — | 0.010 | — |
| 8[b] | 0.050 | — | 0.005 | — |

[a]inlet tube merged into outlet tube
[b]outlet tube surrounded by inlet tube

Figure 2:
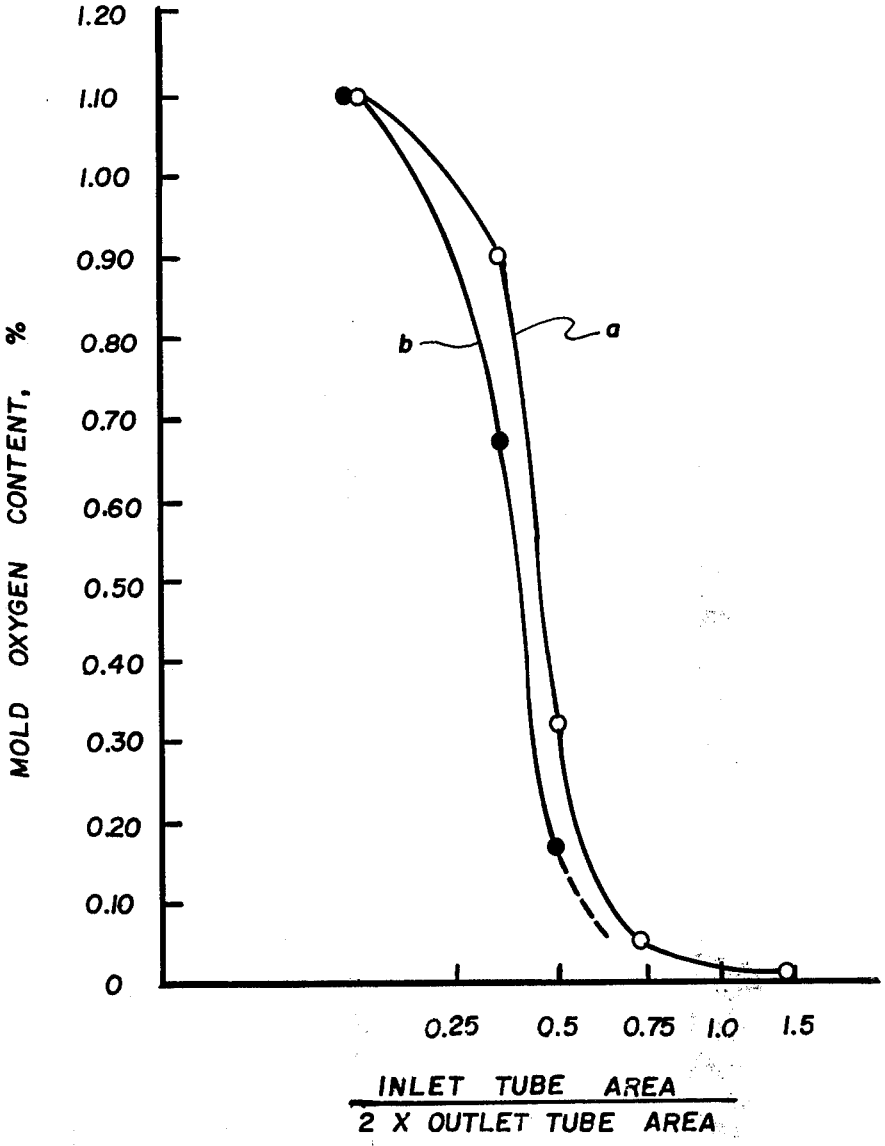
FIG. 2 is a plot of oxygen content in the mold atmosphere and the ratio of cross-sectional area of the inlet tube to two times the cross-sectional area of the outlet tube.

The results set forth in the Table and plotted in somewhat different form in FIG. 2, indicate that inlet barrel size has a major influence upon the degree of protection obtained in the mold. Moreover, oscillation of the mold (and shroud) appeared to result in a slight improvement in purity. The major effect noted from the tubular data is that mold purity improves with increasing inlet tube size.

It is also apparent from the results in the Table for the 8 inches diameter inlet tube that the manner of joining the respective tubes has an influence upon oxygen content in the mold. The shrouding arrangement in which the larger diameter inlet tube was fabricated to gradually merge into the smaller diameter outlet tube resulted in a relatively higher oxygen content than that obtained with use of the other 8 inches diameter inlet tube.

The tubular data also indicate that the respective tube sizes do not appear to have a significant influence upon the purity of the protective atmosphere established at the nozzle.

Figure 3:
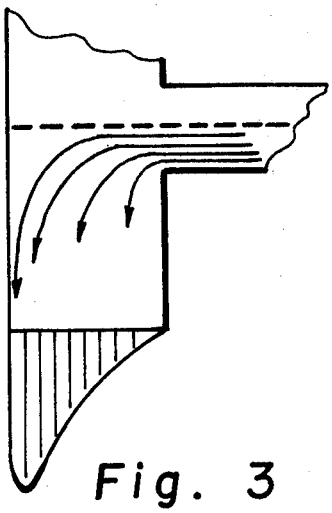
FIG. 3 is a schematic illustration of a gas shroud having a relatively small inlet tube diameter as contrasted with that of its outlet tube.
Figure 4:
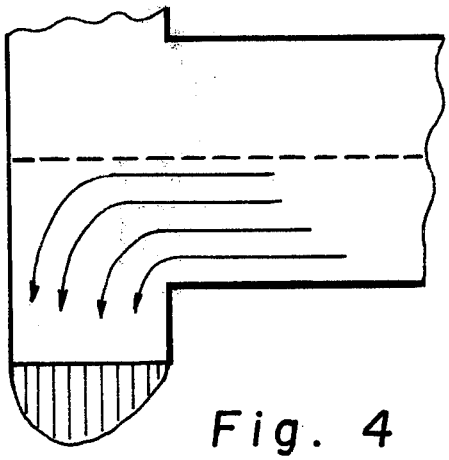
FIG. 4 is a schematic illustration of a gas shroud having a relatively large inlet tube diameter as contrasted with that of its outlet tube.

The improvement in mold oxygen content obtained with larger inlet tube diameters is believed to be attributable to obtaining a more symmetrical and uniform gas flow distribution in the outlet tube. It has been observed in the case of the 2 ½ inches diameter inlet tube trial, that a non-uniform distribution is obtained for gas exiting from the 5 inches diameter outlet tube, i.e., the gas velocity in the area away from the interconnecting passageway is appreciably greater than that on the passageway side. Use of a larger diameter inlet tube has the effect of reducing the gas velocity entering the outlet tube which, in turn, will reduce the velocity of gas flow on the side of the outlet tube opposite to the interconnecting passageway. As a consequence, improved uniformity of gas velocity is obtained. FIG. 3 illustrates the case of a relatively small sized inlet tube relative to that of the outlet tube. FIG. 4 illustrates the influence upon gas velocity distribution with use of a relatively large sized inlet tube relative to that of the outlet tube. The striped area at the lower end of the outlet tubes shown in FIGS. 3 and 4 is a graphical representation of typical gas velocity distributions obtained by the respective combinations of inlet and outlet tubes sizes.

FIG. 2 is a plot of mold oxygen content and the ratio of the inlet tube cross-sectional area to twice that of the outlet tube. Curve a represents stationary conditions while curve b represents oscillating conditions. The ratio was selected as a significant variable because it is believed that the respective cross-sectional areas are representative of the underlying phenoma that leads to improved atmospheric purity in the mold. A factor of two is employed in the denominator portion of the ratio because gas flows in two directions as it passes through the outlet tube. Based upon the plot it is apparent that mold purity reaches a relatively constant low value at a ratio of about 0.7. Therefore, the inlet and outlet tubes should be sized according to the following relationship:

$$\frac{\text{cross-sectional area of inlet tube}}{2 \times \text{cross-sectional area of outlet tube}} \geqq \text{about } 0.7.$$

As implicit from the above discussed relationship, gas shrouds of the invention involve the combination of an inlet tube having a larger inside diameter than that of the outlet tube. One may construct shrouds having the requisite structural relationship in at least two modes. First, the larger inlet tube may be simply generally merged into the outlet tube at the area of the outlet tube closest to that of the inlet tube. Secondly, the respective tubes may be joined in the manner shown in FIG. 1. In this mode of assembly, the inlet tube surrounds an upper and lower outlet tube at the location of the interconnecting passageway. This embodiment is preferred because of relative ease of assembly. Moreover, such embodiment, based upon the data contained in the Table, appears to lead to somewhat lower oxygen content in the mold. It is probable that this effect is because no constriction is present at the point where the respective tubes are joined.

I claim:

1. In the combination of shrouding apparatus comprising an open-ended outlet tubular member, positioned between molten metal distribution means and a continuous casting mold, and an inlet tubular member connected to said outlet tubular member so as to form an interconnecting passageway for passage of protective gas between said tubular members, and gas delivery means connected to said inlet tubular member for passing a protective gas into and through said inlet tubular member so as to cause protective gas to exit from the open ends of said outlet tubular member and pass into and fill said continuous casting mold so as to establish a protective atmosphere in said mold, wherein the improvement comprises:

an inlet tubular member and an outlet tubular member having the following area relationship;

$$\frac{\text{cross-sectional area of inlet tube}}{2 \times \text{cross-sectional area of outlet tube}} \geqq \text{about } 0.7.$$

2. In the combination of claim 1, wherein:

said inlet tubular member surrounds an outlet tubular member comprising upper and lower outlet tubes at said interconnecting passageway location.

* * * * *